United States Patent [19]

Charpentier

[11] 4,248,303

[45] Feb. 3, 1981

[54] EXPLOSIVE WELL-FRACTURING SYSTEM

[75] Inventor: John J. Charpentier, Algiers, La.

[73] Assignee: Xplo Corporation, Gretna, La.

[21] Appl. No.: 965,620

[22] Filed: Dec. 1, 1978

[51] Int. Cl.[3] ..... E21B 43/263

[52] U.S. Cl. ..... 166/299; 102/20; 102/21; 166/63

[58] Field of Search ..... 166/63, 299; 103/20, 103/21, 24 HC, 21.6, 22 R, 23

[56] References Cited

U.S. PATENT DOCUMENTS

| | | | |
|---|---|---|---|
| 2,251,712 | 8/1941 | Mays | 102/21.6 |
| 2,775,940 | 1/1957 | Klotz | 102/23 |
| 2,789,504 | 4/1957 | McCloud et al. | 102/21.6 X |
| 2,831,429 | 4/1958 | Moore | 102/21.6 X |
| 2,837,027 | 6/1958 | Martin | 102/20 X |
| 2,921,519 | 1/1960 | Martin | 102/21.4 |
| 4,018,293 | 4/1977 | Keller | 102/24 HC |
| 4,081,031 | 3/1978 | Mohaupt | 102/21.6 X |
| 4,091,870 | 5/1978 | Godfrey et al. | 166/299 |
| 4,160,412 | 7/1979 | Snyder et al. | 166/63 X |

*Primary Examiner*—David H. Brown

*Attorney, Agent, or Firm*—C. Emmett Pugh & Associates

[57] ABSTRACT

Method of and apparatus for fracturing and creating multiple fissures in hydrocarbon impregnated rock. The invention uses a sequence of explosive charges involving a main, centrally located high velocity, shape charge shot directed out horizontally into the stratum to be fractured, and two supplemental charges of bulk explosives of a lower detonation velocity positioned above and below the main shot and simultaneously detonated following the main charge, the purpose of the sequence and the physical arrangements being to effect greater penetration of the stratum. In the preferred embodiment a metal shaped charge containing a liquid explosive is used for the centrally located main shot comprising a number of longitudinally extended tined spokes directed radially outward from a common center (note FIG. 3). The diameter of the shaped charge can be varied to fit and preferably generally fills up the diameter of the well bore.

8 Claims, 3 Drawing Figures

EXPLOSIVE WELL-FRACTURING SYSTEM

BACKGROUND OF THE INVENTION

1. Field of the Invention

The present invention relates to a method and apparatus for the controlled fracturing of a subterranean earth formation. More particularly, the present invention relates to a system for fracturing and creating multiple cracks of fissures in rock and coal stratum or in an oil well using a particular sequence and arrangement of explosive charges to improve production. The present invention can be used for example in oil fields that have known reserves in hydro-carbon-impregnated rock.

2. State of Prior Art

Using an arrangement of charges of different strengths to effect the fracturing of a well bore is generally speaking a known operation. An example of one suggested method is found in U.S. Pat. No. 87,372 issued Mar. 2, 1869 to Taliaferro P. Shaffer. Although it speaks of a main shot which is used in conjunction with two supplemental charges of a lower detonation velocity to blast the fracture, the three charges are simultaneously fired.

Additionally, U.S. Pat. No. 2,921,519 to T. B. Martin issued Jan. 19, 1960 is of interest in that it speaks of a well-fracturing system in which the main shot is boosted by the use of two supplemental shots of a higher detonation velocity. However, it explicitly requires the firing of the supplemental charges before the central charge. In addition the device has a substantially smaller diameter than that of the well hole.

Of further possible general interest to the present invention are the following: U.S. Pat. No. 2,775,940 to Klotz (issued Jan. 1, 1957) which discloses the use of two or more spaced charges for simultaneous firing in a bore hole for enhancing laterally directed explosive forces; U.S. Pat. No. 2,770,312 to Silverman (issued Nov. 13, 1956) which discloses the use of explosives with different detonation velocities, and U.S. Pat. No. 4,018,293 to Keller (issued Apr. 19, 1977) which discloses a use of various shaped charges for effecting the desired result in controlled fracturing.

As will be seen in the preferred embodiment, the present invention not only uses one main shot in combination with two supplemental charges, but inter alia also employs them in a particular sequence and structural array such that the optimal benefit from the combination is realized to an extent never achieved, it is believed, in the prior art.

SUMMARY DISCUSSION OF THE INVENTION

The basic, over-all object of the present invention is to provide a more effective method for the fracturing of a subterranean earth formation along a horizontal plane.

In contrast to the prior art, the present invention effects the fracturing of a selected stratum by using a sequence of explosive shots in which the centrally located main shot is supplemented by two lower velocity charges detonated following the discharge of the main shot. The supplemental shots are positioned above and below the main shot, are detonated simultaneously with each other, and are directed towards and into and physically follows the main shot.

Such a sequence of shot, allows for a greater distance penetration within the stratum. It is believed that the force action of the main shot, which is directed horizontally into the productive, stratum, creates a vacuum which helps to direct the explosive action of the supplemental shots into opposite sides of the main charge and, from there, into the stratum to be fractured. In this manner, the supplemental shots enforce the action of the main shot and effect a more complete fracturing of the selected subterranean level.

In the preferred embodiment of the present invention, a low-velocity, gas-creating bulk explosive is the material used for the supplemental shots, while a liquid high-velocity explosive contained in a shaped charge device comprises the main shot. The shaped-charged device of the preferred embodiment is circular and comprises a number of tined spokes directed radially outward from a common center and extending longitudinally the full length of the device. V-shaped, air-tight chambers lie between each pair of spokes and function as stand-off air chambers. When the explosive chamber is filled with a liquid explosive and detonated, the shock waves cause the sides of the V-shaped chambers to collapse and impinge with a resultant shock wave directed out to the outer circumference of the shaped charge, bisecting the standoff air chambers and thereby producing a highly magnified shock wave. The number of tined spokes of the shaped charge may be varied in the order to match the diameter of the shaped charge with that of the well bore.

In accordance with one embodiment of this invention, the sequence of shots is accomplished by the following arrangement of explosive material:

A. A pre-determined amount of bulk explosive is deposited in the well bore, up to the level of the stratum to be fractured;

B. A main explosive unit, i.e. the shaped charge of the main shot, is positioned adjacent the portion of the formation to be fractured; and C. An amount of bulk explosive equal to that already deposited in the well is placed on top of the fracturing device.

BRIEF DESCRIPTION OF THE DRAWINGS

For a further understanding of the nature and objects of the present invention, reference should be had to the following detailed description, taken in conjunction with the accompanying drawing, in which like parts are given like reference numerals and wherein.

DESCRIPTION OF THE PREFERRED EMBODIMENT

Figure 1:
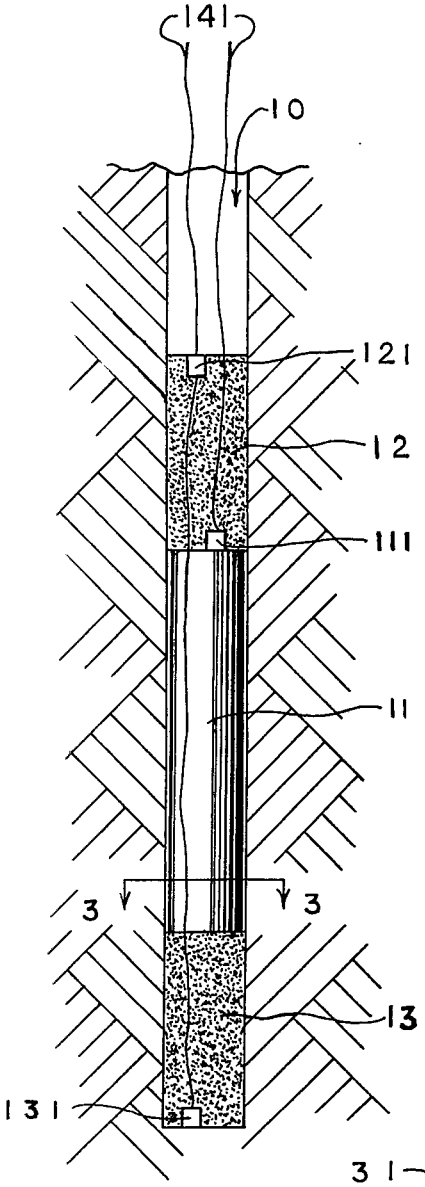
FIG. 1 is a side, sectional, schematic and generalized view, illustrating the distribution of explosive charges within the bore hole in accordance with the preferred embodiment of the present invention.

A cross-sectional side view of the bore hole 10 is shown in FIG. 1. The explosive charge comprises a set of individual charge units 11, 12, & 13, which are positioned sequentially into the borehole 10 in such a way they take aligned end-to-end positions. The arrangement of the individual units is such that supplemental units 12 and 13 are positioned respectively above and below the main explosive unit 11.

The individual units 11, 12 & 13 are detonated by suitable detonation means connected to the detonators 111, 121 and 131 respectively. The detonating means may include for example the use of customary booster, primer or blasting caps as the detonators. The blasting caps may be initiated from a conventional electrical firing mechanism, not shown, but located at the surface and connected through the detonating circuit conductors or wires 112, 122 and 132 to each of the detonating means.

The main or primary explosive unit 11 is initially detonated ahead of the supplemental or secondary units 12 & 13 by for example a few microseconds. The shaped charge which comprises the main unit provides a highly effective directioning means so that the explosive force it generates is directed transversely outward into the productive stratum. The following force action of the supplemental shots (those of units 12 and 13) is directed into the main shot (that of unit 11) and so into the productive stratum by it is believed the vacuum created by the leading, outward force of the main shot. In the preferred embodiment, the main shot is of a higher velocity than the supplemental shots in order that the vacuum produced by the main shot might be stronger and more effective in directing the gases released by the supplemental shots. The explosive force released by the supplemental units is timed to strike or hit opposite side of the main unit at the same time and immediately after the main unit is detonated.

Figure 2:
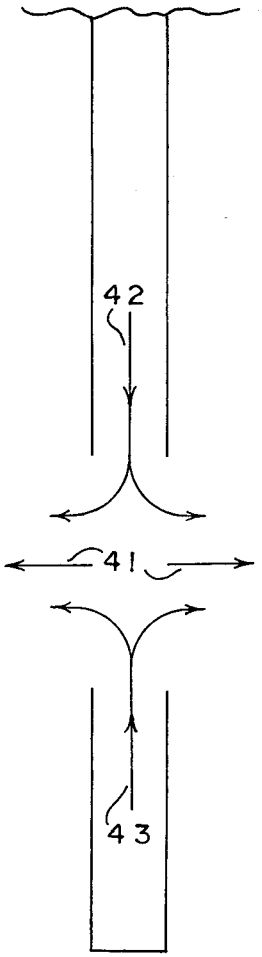
FIG. 2 is a side, sectional, schematic force vector diagram showing the explosive force action of the preferred embodiment of FIG. 1.

The final explosive force action is schematically shown in Fig. 2. The explosive action of the main shot 11 is directed radially outward into the stratum to be fractured as indicated by the force lines 41. The explosive actions of the supplemental shots 12 and 13 are directed into the main shot and then outward into the stratum as indicated by force lines 42 and 43 respectively. The force action afforded by the use of two supplemental shots in conjunction with one main shot in the sequence prescribed by the present invention allows for a much greater penetration within the productive stratum and is an important advantage of the present invention. It is believed that the main shot 11 serves as a siphon pulling the force of the supplemental shots 12 and 13 behind it.

Figure 3:
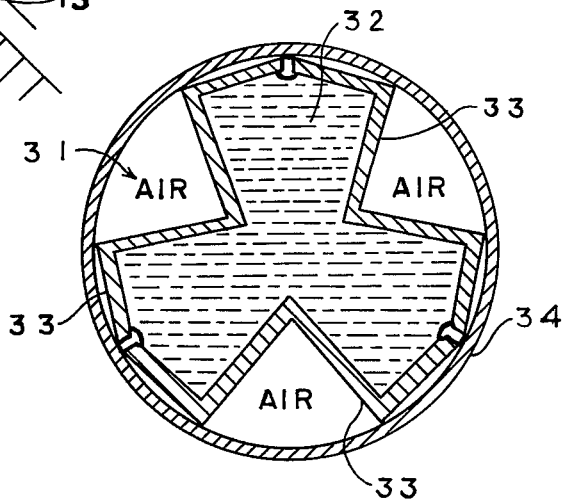
FIG. 3 is a horizontal or transverse cross-sectional view, taken along section line 3—3, of the centrally located shaped charge of the preferred embodiment of FIG. 1.

The basic transverse, cross-sectional configuration of the main explosive unit 11 is shown in FIG. 3. The one-piece device includes a hollow explosive chamber 32 formed by walls 33 into a number of spokes radiating from a common center and longitudinally or axially extending the full length of the device. Integrally formed with the explosive chamber 32 is an adjacent air-tight, stand-off chamber 31 formed between the walls 33 of the explosive chamber and an outer cylindrical wall of the device 34. As can be seen, the air-tight stand-off chambers 31 comprise a number of V-shaped spaces.

For safety purposes, a non-detonable multi-component explosive is used with the shaped-charge device of the present invention and is placed in the explosive chamber 32 by any conventional means such as for example by pouring it in through a capped opening in top of the casing 32/34. An example of such an explosive is that marketed under the trade mark "Xplo Cajun Marine Pac" by Explo Precision Engineering Corporation of Gretna, LA. "Xplo Cajun Marine Pac" is a two-component liquid explosive system. Each component is separately non-detonatable and classified as non-hazardous prior to mixing. It may be transported and stored in conventional vehicles or facilities. When mixed, "Xplo Cajun Marine Pac" becomes a Class "A" high explosive weighing about thirty-nine pounds per cubic foot with a detonation velocity of more than eight thousand meters per second and must be handled, transported and stored and used in accordance with local, state, federal and international laws.

For the supplemental shots 12 and 13, generally any gas-creating, low-velocity bulk explosive may be used having an exemplary velocity of for example, six thousand meters per second. In these supplemental shots speed or velocity is not primarily important but generally most important is the creation of gas.

Since loose bulk explosives are preferably used for the supplemental shots 12 and 13, the lowermost position of the bottom bulk explosive 13 may have to be supported above the bottom of the hole in any one of several conventional ways depending upon the level of the fracturing to be created such as for example by pouring cement into the hole.

The cylindrical member 34 of the central charge 11 is sized to preferably closely approach the diameter of the hole 10 and thus fill it in the lateral direction leaving just enough room for it to be maneuverable within the hole. This puts the exterior surface of the cylindrical member 34 in mear face-to-face engagement with the hole. An exemplary structure for the central charge 11 would be an aluminum device having a six inch diameter and being fifteen feet in length. With the inner chamber 32 filled with "Xplo Cajun Marine Pac", a ton of bulk explosive having a six thousand meter per second velocity for each of the supplemental shots 12 and 13 is exemplary.

In use the lower supplemental shot 13 is positioned down in for example the "rat hole" portion of the hole 10 in loose, bulk form and supported as needed and with its booster cap 131 located at the bottom of the shot. The central shaped charge 11 is then lowered by means of cables or lines attached to for example pad eyes (not illustrated) on the body of the charge 11 with the liquid explosive in the chamber 32 until it reaches the lower shot 13. Finally the explosive bulk material for the upper shot 12 is positioned on top of the central charge 11 with its booster cap 121 located at its top. Of course prior to the positioning of the charges 11–13 the hole 10 has been surveyed and measured so that the charges can be appropriated, sized and constituted. After all the explosive charges are in position, the central charge 11 is ignited, with the supplemental charges being ignited simultaneously with each other thereafter.

In addition to well fracturing for oil well use, it is noted that the present invention could be useful in coal mining and such use is contemplated to be within the scope of this invention.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. The method of fracturing wells comprising the following steps:

(a) positioning in the well holes a first, relatively low velocity, supplemental explosive charge at a position below the area to be fractured;

(b) positioning in the well hole a relatively high velocity, central explosive charge at a position next to the area to be fractured and adjacent said first charge;

(c) positioning in the well hole a second, relatively low velocity supplemental explosive charge at a position above the area to be fractured and adjacent the top of said central charge, (d) detonating said central charge; and (e) thereafter detonating said first and second supplemental charges.

2. The method of claim 1 wherein in step "e" the supplemental charges are detonated simultaneously.

3. The method of claim 2 wherein in step "e" the supplemental charges are detonated within a few microseconds of detonating the central charge.

4. The method of claim 1 wherein in steps "a" and "c" said first and second supplemental charges are positioned by placing in the hole explosives in loose bulk form.

5. The method of claim 4 wherein in step "b" said central charge is provided in the form of an elongated body with the explosive located in the central area thereof behind longitudinally extending "V" shaped air stand-off areas and is lowered down in the hole in unitary form.

6. An explosive system for fracturing a well comprising:

a first, lower, relatively low velocity, supplemental explosive charge in bulk form;

a relatively high velocity, central explosive shaped charge comprising a cylindrical metal member containing a liquid explosive in its cental area extending axially at least substantially the full axial length of said cylindrical member and surrounded by longitudinally extending air stand-off areas in said cylindrical member having at least a general "V" shape to each of them with their apexes located to the inside of said cylindrical members; and a second, upper, relatively low velocity, supplemental explosive charge in bulk form; said three charges being associated for positioning in the hole with said central charge located adjacent the area to be fractured with said first and second supplemental charges being located below and above it respectively.

7. The system of claim 6 wherein the diameter of said cylindrical member is comparable to the diameter of the hole to thereby fill up the hole with the exterior surface of said cylindrical member being in near face-to-face engagement with the hole.

8. The system of claim 6 wherein there is further included detonation means associated with said three charges for initially detonating said central charge and thereafter detonating said supplemental charges simultaneously with each other.

* * * * *